US011034496B1

(12) United States Patent
Hsieh

(10) Patent No.: US 11,034,496 B1
(45) Date of Patent: Jun. 15, 2021

(54) HANGING TAG FOR TOOLS

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 16/803,397

(22) Filed: Feb. 27, 2020

(51) Int. Cl.
*B65D 75/56* (2006.01)
*B65D 73/00* (2006.01)

(52) U.S. Cl.
CPC ..... *B65D 73/0064* (2013.01)

(58) Field of Classification Search
CPC ..... B65D 73/0014; B65D 73/0021; B65D 73/0064; A47F 7/024
USPC ..... 206/349, 376, 379, 461, 806, 807; 211/70.6
See application file for complete search history.

(56) References Cited

U.S. PATENT DOCUMENTS 5,044,591 A * 9/1991 Huang ..... B65D 73/0014 248/317
6,378,700 B1 * 4/2002 Tong ..... B65D 73/0064 206/349
6,679,379 B1 * 1/2004 Kao ..... A47F 5/0006 206/349
2004/0000497 A1 * 1/2004 Huang ..... B25H 3/04 206/376
2004/0050734 A1 * 3/2004 Kao ..... B65D 73/0014 206/370
2005/0061757 A1 * 3/2005 Chiang ..... B65D 73/0064 211/70.6
2005/0067307 A1 * 3/2005 Kao ..... B65D 73/0064 206/349
2007/0007154 A1 * 1/2007 Wu ..... B65D 73/0064 206/349

FOREIGN PATENT DOCUMENTS

CN 204617715 U 9/2015
EP 3156192 A1 4/2017
TW 200642811 A 12/2006
TW M371626 U 9/2009
TW 201603971 A 2/2016

* cited by examiner

*Primary Examiner* — Luan K Bui
(74) *Attorney, Agent, or Firm* — Egbert Law Offices, PLLC

(57) ABSTRACT

A hanging tag for tools includes a main body and a set of stopping members provided on the front side of the main body. The main body includes a vertical plate and two side plates. Each of the side plates forms a stopper, and the set of stopping members includes a middle plate, two connecting plates and two baffles. The middle plate is opposite to the vertical plate, and a tool is arranged between the vertical and middle plates, and each of the connecting plates is elastically hooked with each of the side plates. Each of the baffles is opposite to the outside of each of the connecting plates. The hanging tag can avoid theft of the tool. After removing the tool from the hanging tag, the tool can be set back again by using the hanging tag, thereby improving the convenience of storing the tool.

10 Claims, 11 Drawing Sheets

HANGING TAG FOR TOOLS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a hanging tag for toolsn and more particularly to an innovative structure type of a theft-proof hanging tag for tools.

2. Description of Related Art Including Information Disclosed Under 37 CFR 1.97 And 37 CFR 1.98

Spanners and tools for tool racks with sleeves can be hanged on hanging tags for tools for display. The known hanging tag for tools comprises a main body and a locating piece. The tool is arranged between the main body and the locating piece. The locating piece is fastened on the main body by an elastic fastening part, so that the locating piece and the main body oppositely constrain the tool. To separate the tool from the known hanging tag for tools, the fastening part must be broken by scissors or other tools, so as to avoid theft stealing the tool.

The known hanging tag for tools still has the following problems and defects in practical application. When a consumer buys the tool together with the known hanging tag for tools, once the fastening part is destroyed to take the tool, the known hanging tag for tools cannot be used to arrange the tool again.

Therefore, for the aforesaid problems in the known technology of hanging tag for tools, how to develop an innovative structure with more ideal practicability is the objective and direction of the related circles. In view of this, based on the inventor's years' experience in manufacturing, developing and designing related products, the present invention with practicability is obtained after detailed design and careful evaluation for the aforesaid objective.

BRIEF SUMMARY OF THE INVENTION

The primary object of the present invention is to provide a hanging tag for tools, the technical problem to be solved is to break through how to develop a novel hanging tag for tools with more ideal practicability.

Based on said object, the technical characteristic of problem solving of the present invention is that the hanging tag for tools comprises:

a main body, the main body comprises a vertical plate and two side plates, wherein each of the side plates is provided on both sides of the vertical plate respectively, and each of the side plates extends forward, each of the side plates forms a stopper on the front side of the vertical plate; the main body is provided with several limiting plates, each of the limiting plates is in contact with the top edge and bottom edge of each of the side plates respectively, and a demountable set of stopping members is provided on the front side of the main body; the set of stopping members comprises a middle plate, two connecting plates and two baffles; wherein the middle plate and the vertical plate are vertically opposite to each other, so that a tool is arranged between the vertical plate and the middle plate, and the set of stopping members oppositely limits the tool, the connecting plates are laterally opposite to each other; the front side of each of the connecting plates is in contact with the middle plate; each of the connecting plates forms a hook part; the top edge and bottom edge of each of the connecting plates are opposite to each of the limiting plates respectively, each of the connecting plates is elastically hooked with the stopper of each of the side plates through each of the hook parts;

each of the baffles is provided on the front side of each of the side plates, and each of the baffles is opposite to the outside of each of the connecting plates; a basal portion extends to the top edge and bottom edge of each of the baffles from the middle plate; the top edge and bottom edge of the baffle are in contact with each of the basal portions through a shearing part, so that the shearing part can be destroyed by a shearer to remove the baffles, and the set of stopping members can be separated from the main body to get the tool.

In terms of main effect and advantages, the present invention can avoid theft stealing the tool installed on the hanging tag for tools. After removing the tool from the hanging tag for tools, the tool can be set back again by using the hanging tag for tools, thereby improving the convenience of storing the tool.

DETAILED DESCRIPTION OF THE INVENTION

Figure 1:
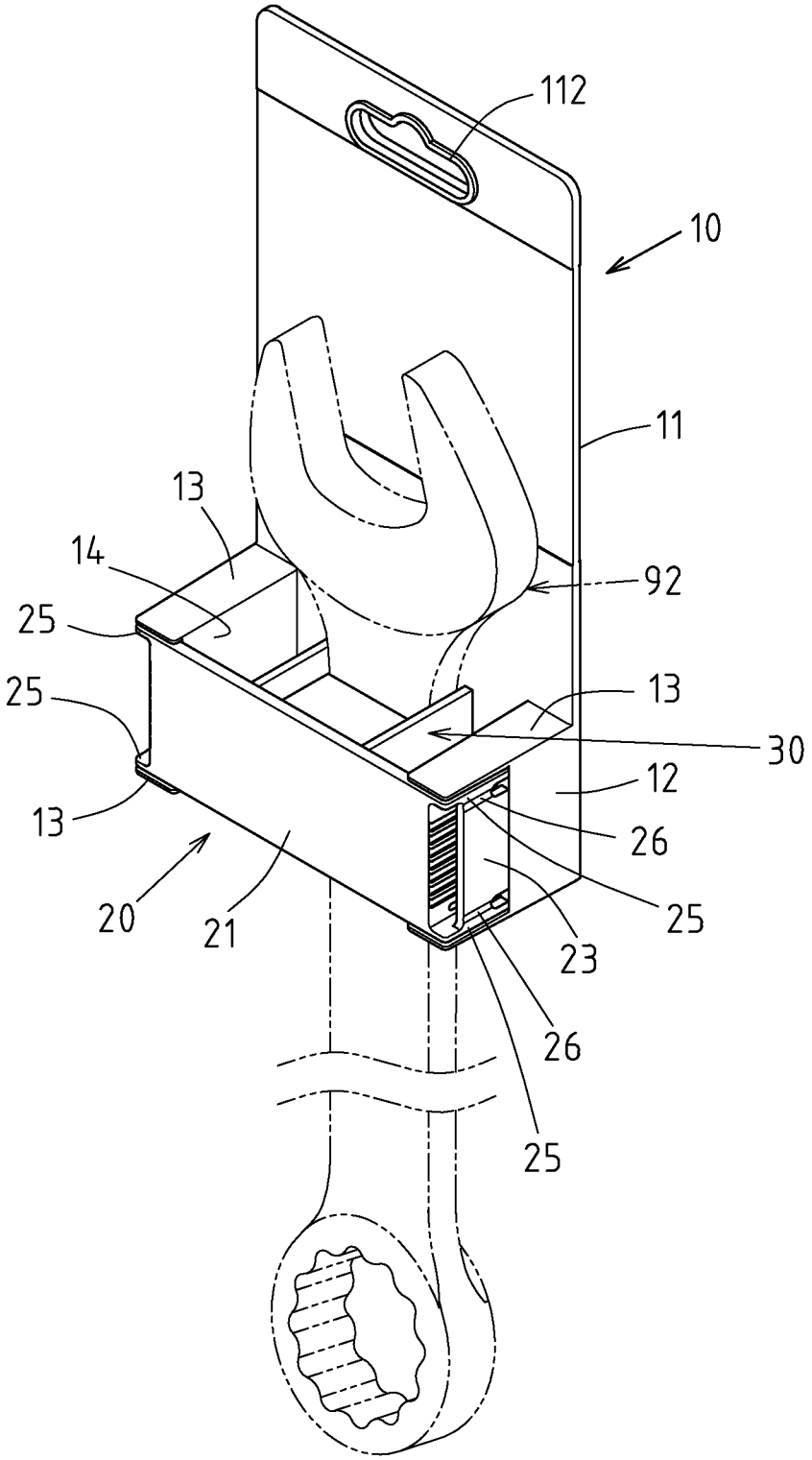
FIG. 1 is the three-dimensional diagram of Embodiment 1 of the present invention.
Figure 2:
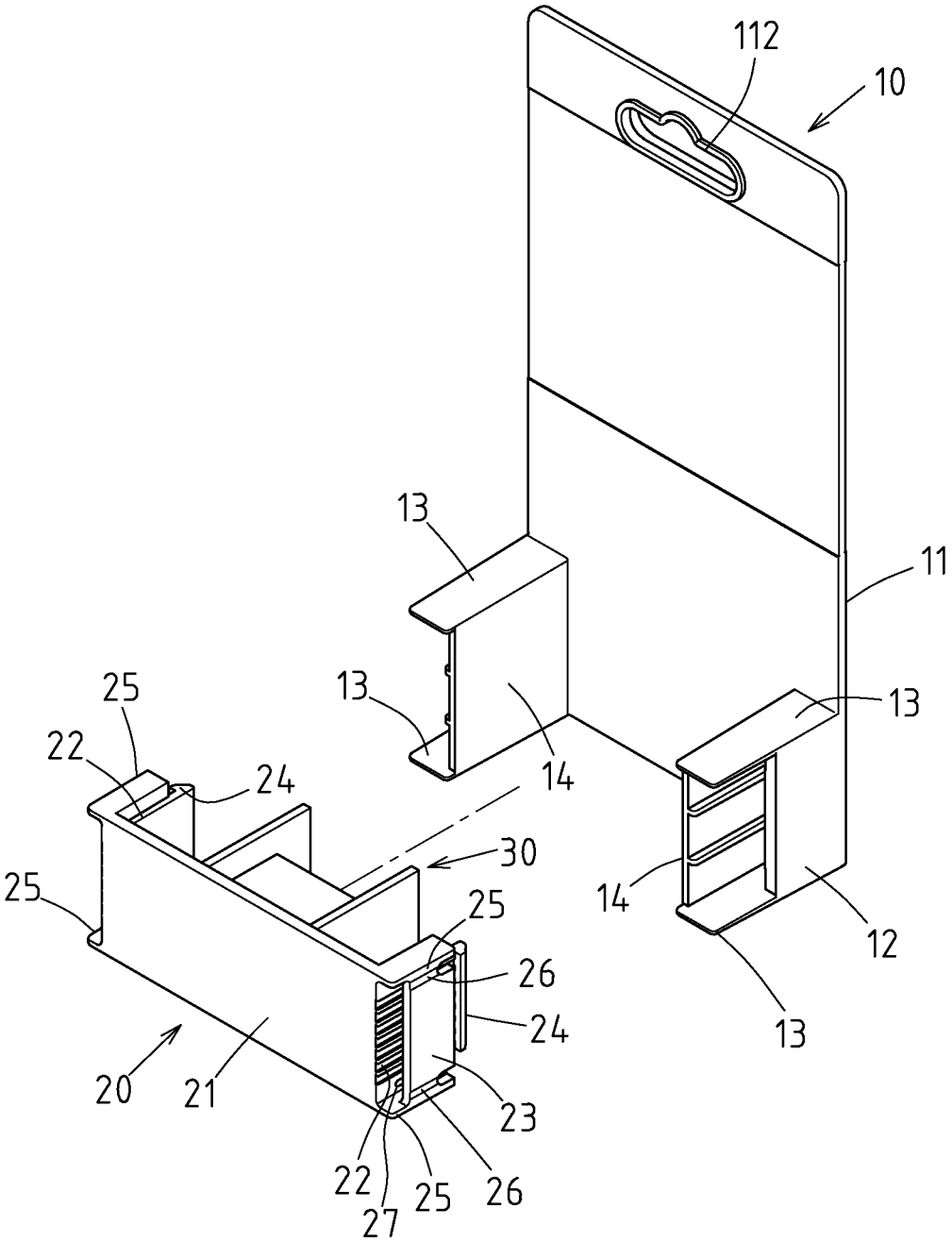
FIG. 2 is the three-dimensional exploded diagram of Embodiment 1 of the present invention.
Figure 3:
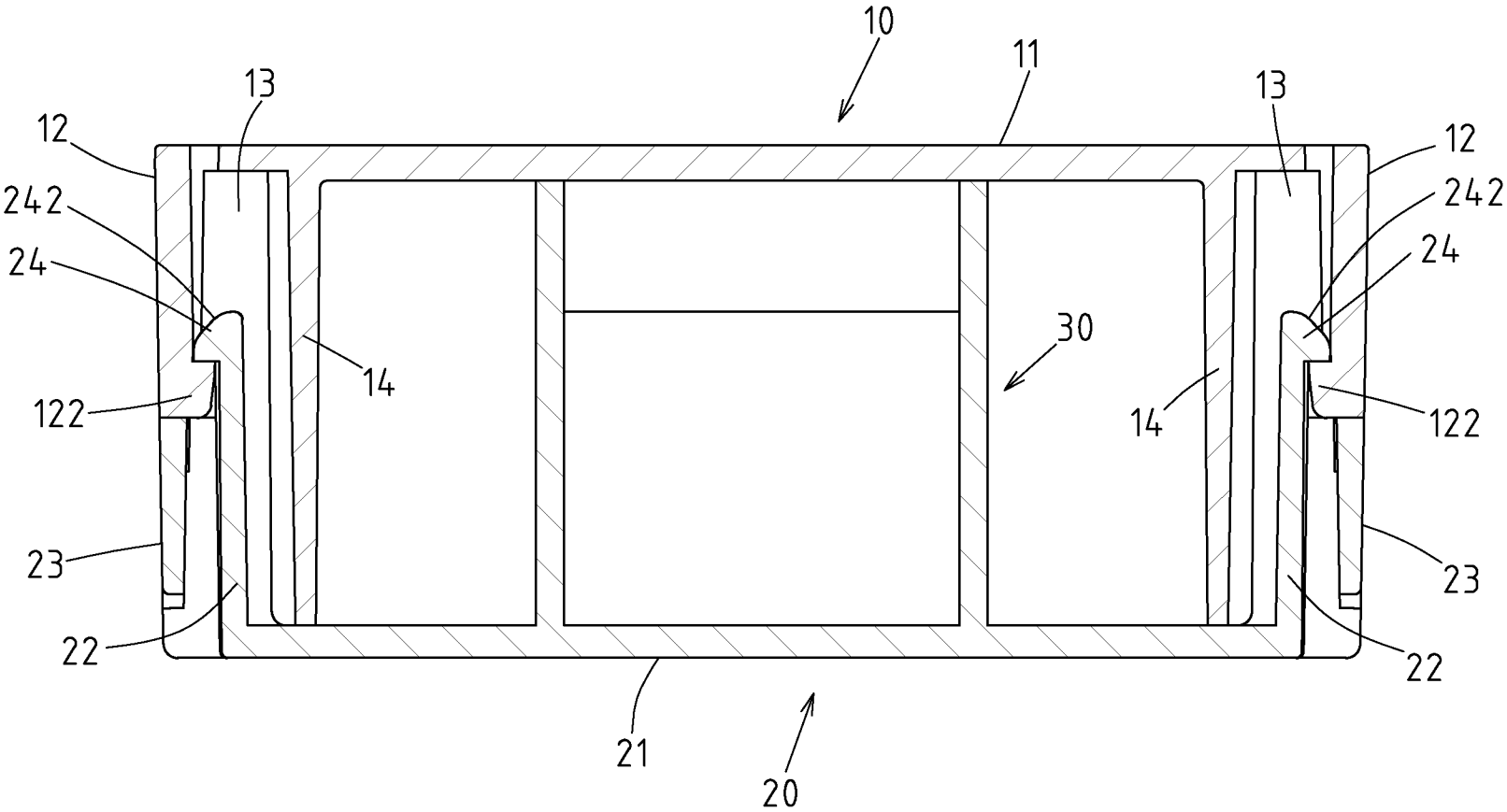
FIG. 3 is the transverse sectional view of Embodiment 1 of the present invention.
Figure 4:
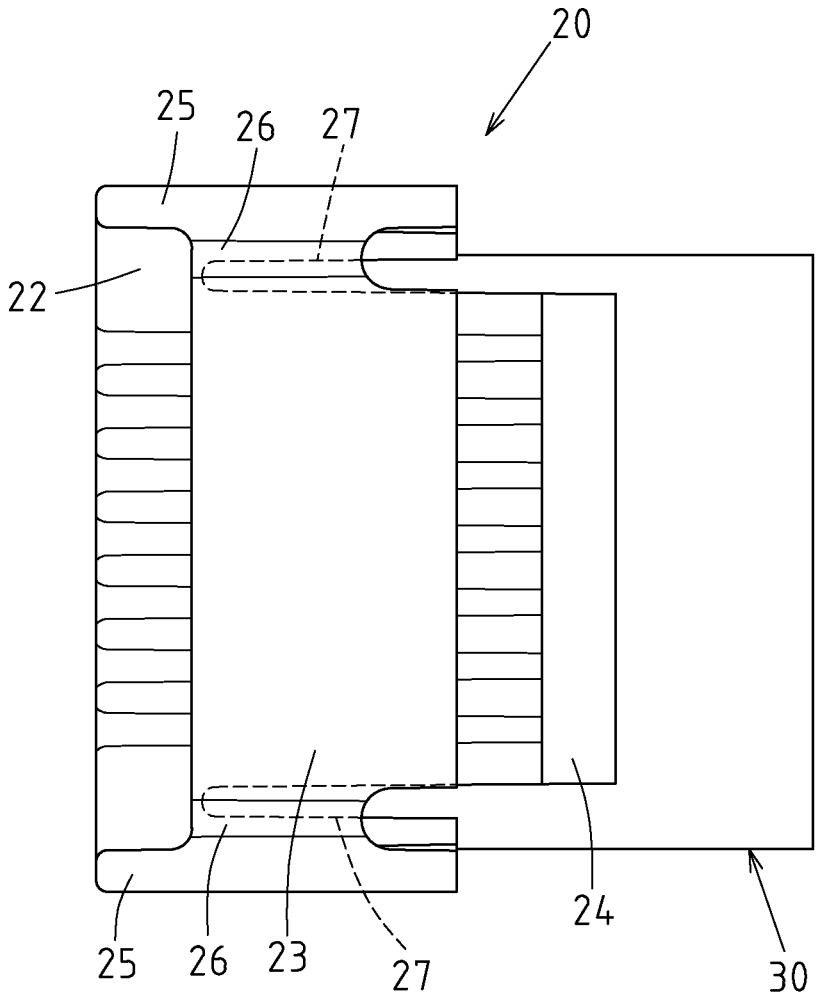
FIG. 4 is the right side view of stopping member of Embodiment 1 of the present invention.

FIG. 1 to FIG. 11 show several embodiments of the hanging tag for tools of the present invention, but the embodiments are for illustration only, the patent application is not limited to this structure.

As shown in FIG. 1 to FIG. 4, Embodiment 1 of said hanging tag for tools comprises a main body 10 and a set of stopping members 20, wherein the set of stopping members 20 is removably provided on the front side of the main body 10. The main body 10 comprises a vertical plate 11 and two side plates 12, wherein the vertical plate 11 is provided with a hanging hole 112, so that the main body 10 can be hanged. Each of the side plates 12 is provided on both sides of the vertical plate 11 respectively, and each of the side plates 12 extends forward, each of the side plates 12 forms a stopper 122 on the front side of the vertical plate 11. The main body 10 is provided with several limiting plates 13. Each of the limiting plates 13 is in contact with the top edge and bottom edge of each of the side plates 12.

Figure 5:
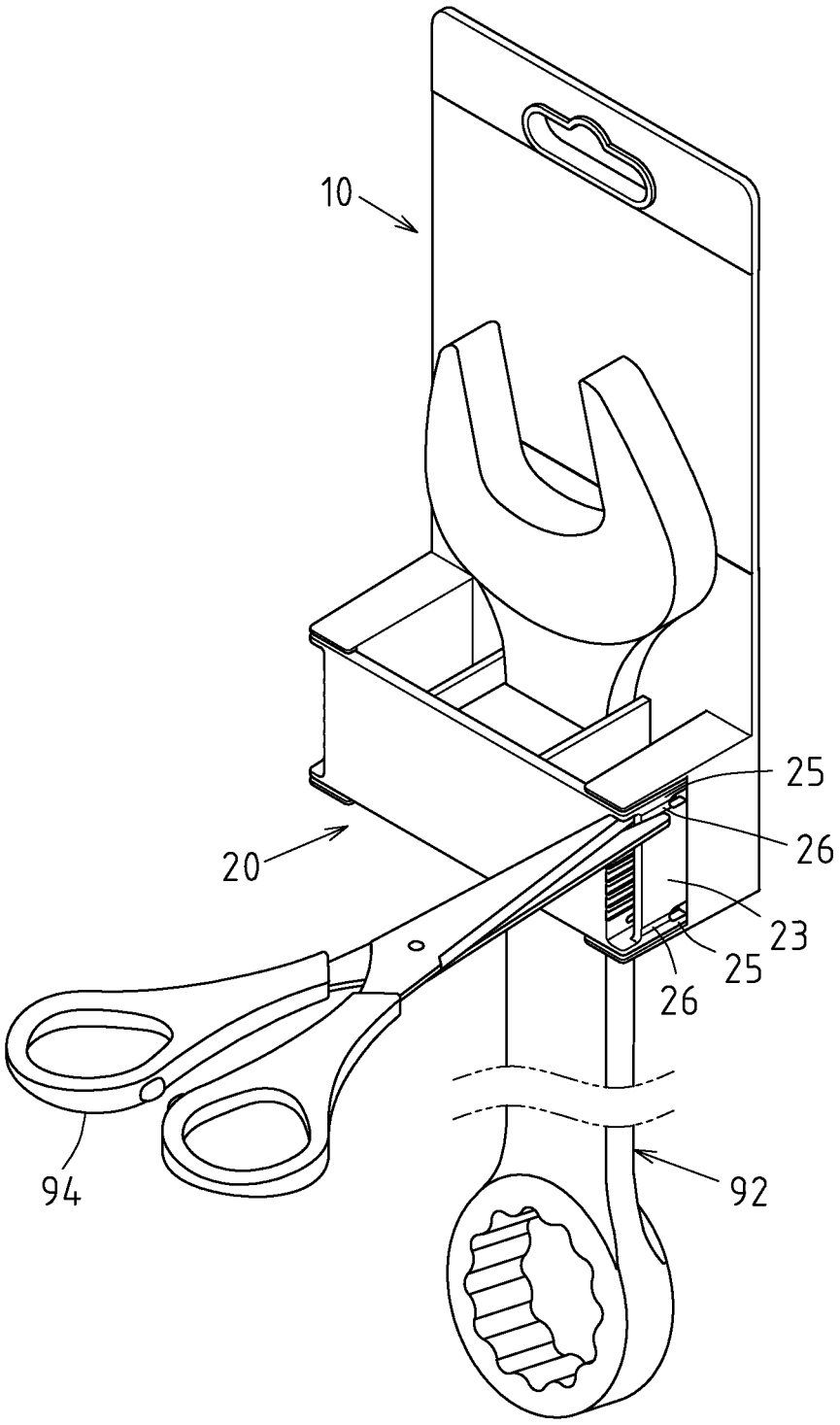
FIG. 5 is the three-dimensional diagram of the operating state of using a shearer to destroy the shearing part in Embodiment 1 of the present invention.

The set of stopping members 20 comprises a middle plate 21, two connecting plates 22 and two baffles 23, wherein the middle plate 21 and the vertical plate 11 are vertically opposite to each other, so that a tool 92 is provided between the vertical plate 11 and the middle plate 21, and the set of stopping members 20 oppositely limits the tool 92 to demonstrate the tool 92. As shown in FIG. 1, the tool 92 is a spanner, the hanging tag for tools of the present invention can be used to set up and demonstrate different tools. FIG. 1 does not limit the use of the present invention. The connecting plates 22 are laterally opposite to each other. The front side of each of the connecting plates 22 is in contact with the middle plate 21. The top edge and bottom edge of each of the connecting plates 22 are opposite to each of the limiting plates 13 respectively. Each of the limiting plates 13 limits each of the connecting plates 22, so that the set of stopping members 20 cannot move up or down. Each of the connecting plates 22 forms a hook part 24. Each of the connecting plates 22 is elastically hooked with the stopper 122 of each of the side plates 12 through each of the hook parts 24. Each of the baffles 23 is provided on the front side of each of the side plates 12, and each of the baffles 23 is opposite to the outside of each of the connecting plates 22. A basal portion 25 extends to the top edge and bottom edge of each of the baffles 23 from the middle plate 21. The top edge and bottom edge of the baffle 23 are in contact with each of the basal portions 25 through a shearing part 26. In this case, the thickness of the shearing part 26 is smaller than the thickness of the baffle 23, so that the shearing part 26 is easy to be destroyed by a shearer 94 (as shown in FIG. 5) to remove the baffles 23, and the set of stopping members 20 can be separated from the main body 10 to get the tool 92. The thickness of the shearing part 26 can be changed as required. The thickness of the shearing part 26 is not up to the thickness of the baffle 23.

Based on the aforesaid structural composition and technical characteristics, when said hanging tag for tools of the present invention is used to set up the tool 92, due to the confinement of the limiting plates 13, the set of stopping members 20 cannot move up or down. The connecting plates 22 are hooked with the stopper 122 of the side plates 12 respectively through the hook part 24. Each of the stoppers 122 stops each of the hook parts 24 on the front side of each of the hook parts 24, so that the set of stopping members 20 cannot move forward to leave the main body 10, and each of the baffles 23 shields each of the connecting plates 22, the connecting plates 22 cannot be touched and pressed oppositely, the limit of each of the stoppers 122 to each of the hook parts 24 cannot be cancelled, so that the tool 92 cannot be separated from said hanging tag for tools of the present invention to avoid theft stealing the tool 92.

Figure 6:
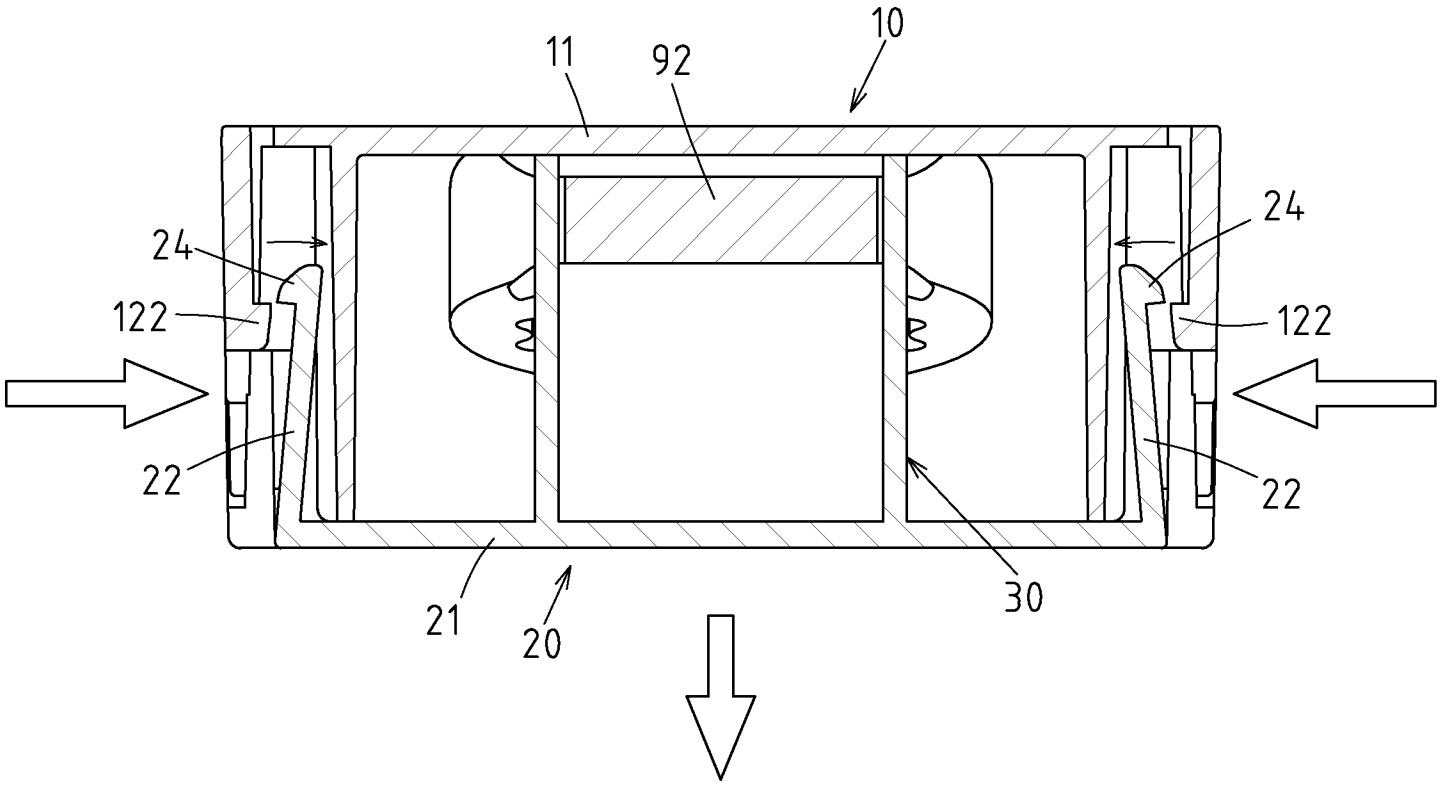
FIG. 6 is the transverse section view of the operating state of tool withdrawal in Embodiment 1 of the present invention.

As shown in FIG. 5, to take out the tool 92, each of the shearing parts 26 can be destroyed by the shearer 94, and then each of the baffles 23 can be removed, the outside of each of the connecting plates 22 is exposed. Afterwards, as shown in FIG. 6, the connecting plates 22 can be pressed oppositely by fingers (not shown in the picture), the connecting plates 22 spring inwards respectively. When the hook parts 24 shift laterally and the limit of the stoppers 122 to the hook parts 24 is cancelled, the set of stopping members 20 can be moved forward. The tool 92 can be taken out after the set of stopping members 20 is disengaged.

Figure 7:
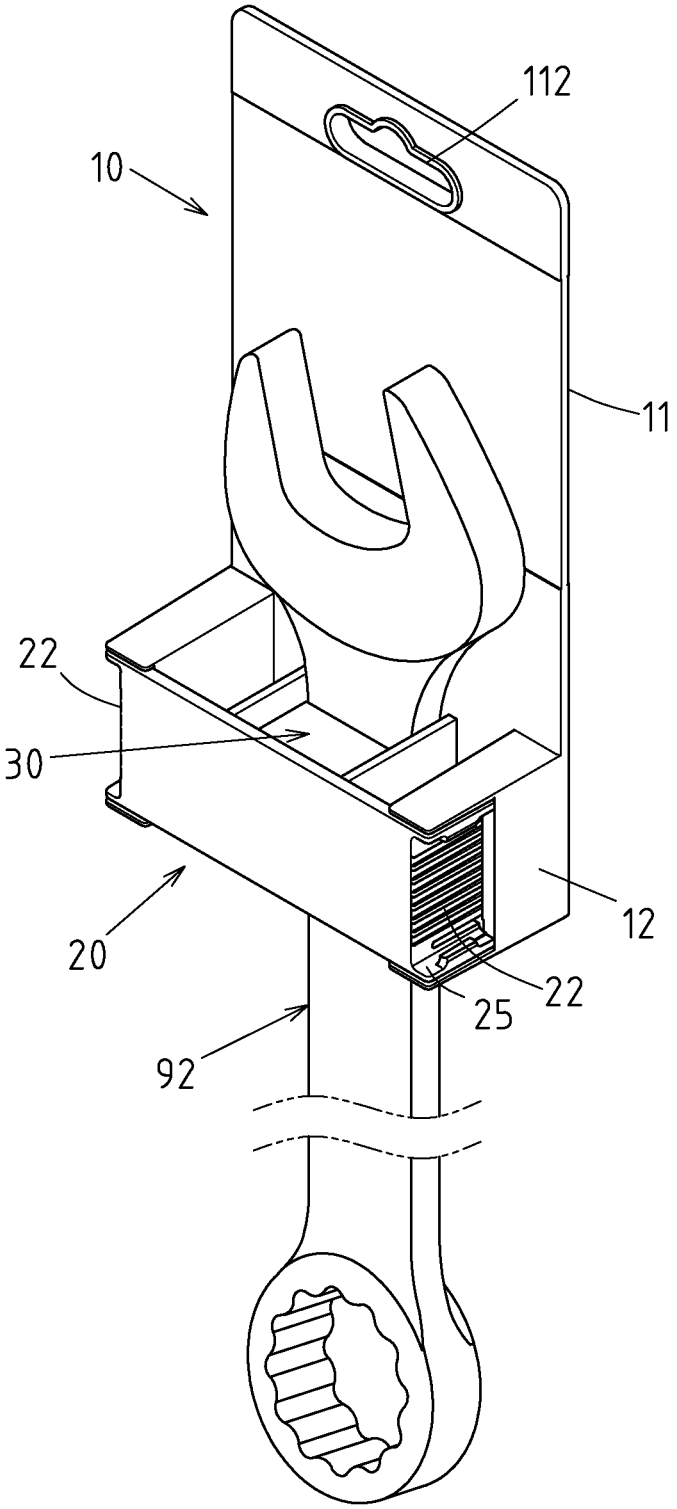
FIG. 7 is the three-dimensional diagram of removing baffles for setting up the tool in Embodiment 1 of the present invention.

As shown in FIG. 7, when the baffles 23 are removed, the tool 92 can be provided on the front side of the vertical plate 11 again, and the set of stopping members 20 is assembled on the main body 10 again, so that the connecting plates 22 are hooked with the stoppers 122 of the side plates 12 respectively through the hook parts 24, the tool 92 can be arranged by using said hanging tag for tools of the present invention, enhancing the convenience of tool storage.

As shown in FIG. 1 to FIG. 4, the main body 10 has two reinforcing plates 14 between the side plates 12, the reinforcing plates 14 are laterally opposite to each other, and the reinforcing plates 14 are adjacent to the side plates 12 respectively. The top edge and bottom edge of each of the reinforcing plates 14 are in contact with each of the limiting plates 13, so as to reinforce the limiting plates 13. In this case, the reinforcing plates 14 can be adjacent to the connecting plates 22 respectively. Therefore, when each of the connecting plates 22 is pressed and sprung inwards, the reinforcing plates 14 can limit the angle of the inward elastic actuation of the connecting plates 22 respectively, so as to avoid excessive deformation of the connecting plates 22 inducing irrecoverable plastic deformation. An oblique guide face 242 is formed on the rear side of the hook parts 24, when the set of stopping members 20 is assembled on the main body 10, each of the connecting plates 22 moves toward the vertical plate 11. When each of the hook parts 24 contacts the front side of each of the stoppers 122, the oblique guide faces 242 make the connecting plates 22 wobble elastically and inwards, so that the hook parts 24 can slide through the inside of the stoppers 122 and move towards the rear side of the stoppers 122, the convenience of assembling the set of stopping members 20 on the main body 10 is enhanced.

The top edge and bottom edge of the connecting plates 22 are in contact with the basal portions 25 respectively, the basal portions 25 enhance the bonding strength between the connecting plates 22 and the middle plate 21. A notch 27 is formed near the top edge and bottom edge of the connecting plates 22 respectively. The notches 27 extend on the rear side of the connecting plates 22, and the hook parts 24 are formed between the notches 27, the notches 27 enable the connecting plates 22 to spring laterally, enhancing the convenience of removing the set of stopping members 20 from the main body 10 and assembling the set of stopping members 20 on the main body 10. The stoppers 122 extend to the top edge of the side plates 12 and the bottom edge of the side plates 12, in contact with the limiting plates 13.

Said hanging tag for tools of the present invention comprises a fixing part 30, the fixing part 30 is located between the vertical plate 11 and the middle plate 21, so as to enhance the reliability of positioning the tool 92. In this case, the fixing part 30 is in contact with the middle plate 21, and the fixing part 30 extends towards the vertical plate 11, so that the fixing part 30 oppositely contacts the tool 92, enhancing the reliability of positioning the tool 92.

Figure 8:
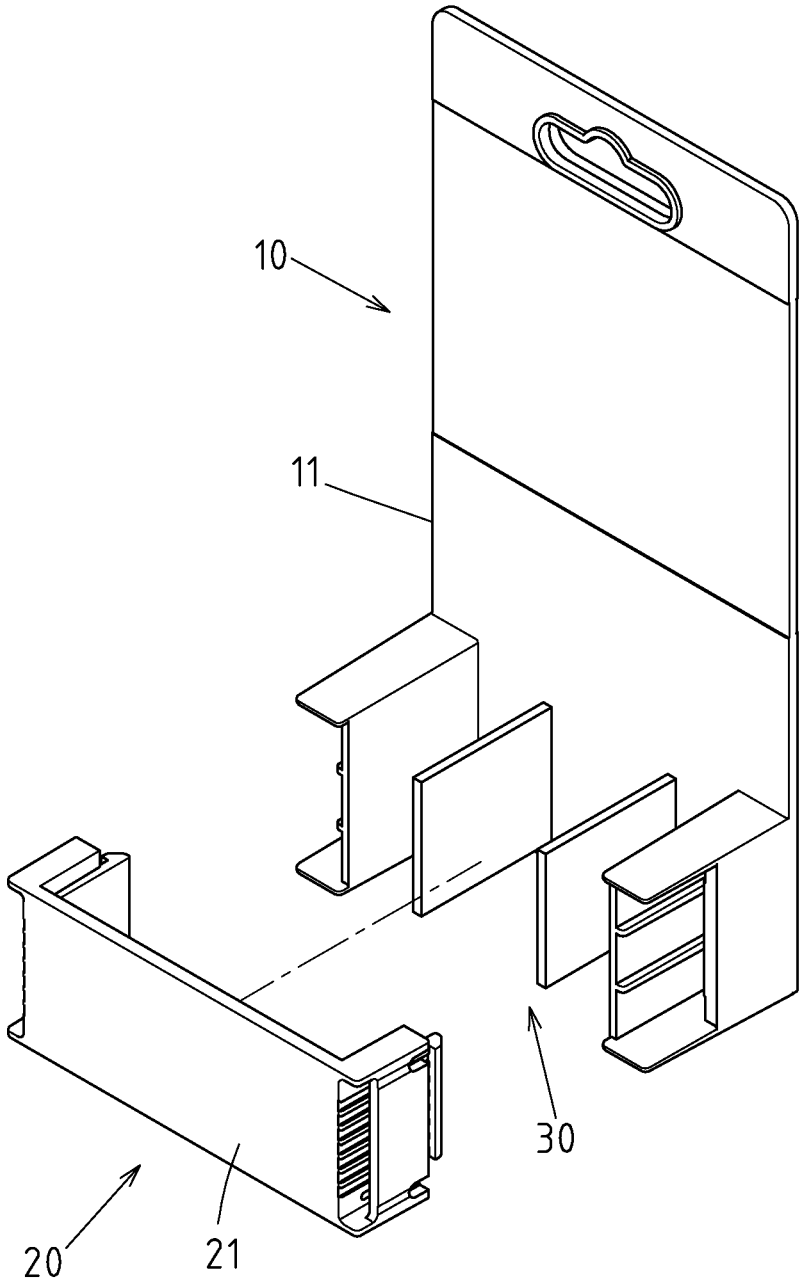
FIG. 8 is the three-dimensional exploded diagram of Embodiment 2 of the present invention.

As shown in FIG. 8, the major difference between Embodiment 2 and Embodiment 1 is that the fixing part 30 is in contact with the vertical plate 11, and the fixing part 30 extends towards the middle plate 21, so that the fixing part 30 oppositely limits the tool 92, enhancing the reliability of positioning the tool 92.

Figure 9:
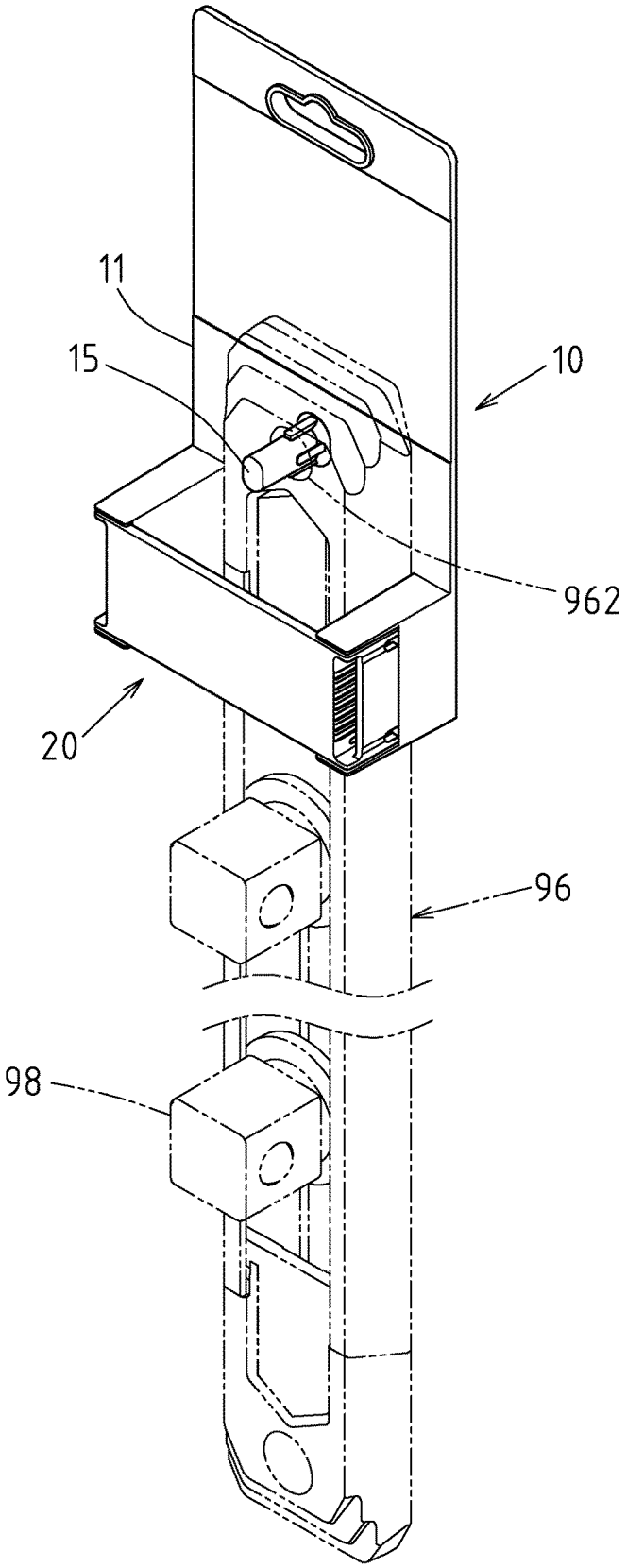
FIG. 9 is the three-dimensional diagram of Embodiment 3 of the present invention.
Figure 10:
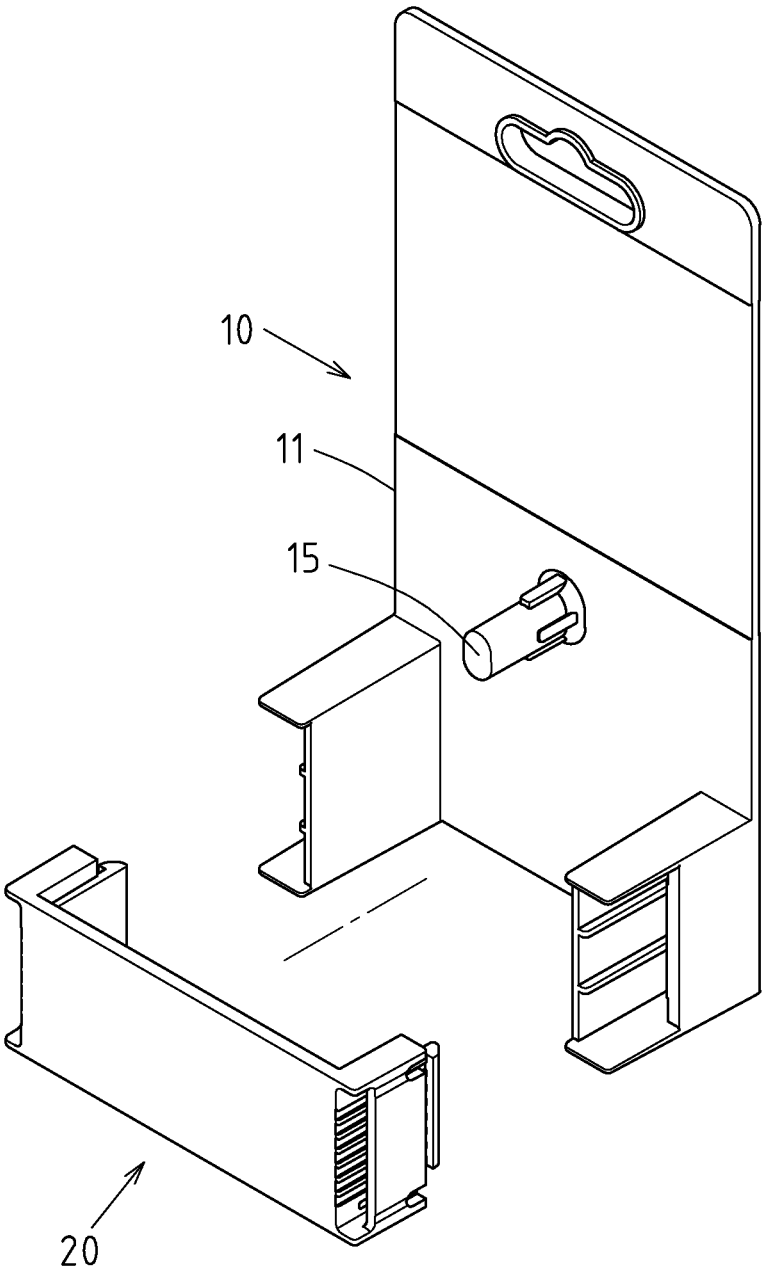
FIG. 10 is the three-dimensional exploded diagram of Embodiment 3 of the present invention.

The major difference between Embodiment 3 and Embodiment 1 is that Embodiment 3 is free of the fixing part 30 of Embodiment 1, as shown in FIG. 9 and FIG. 10, the main body 10 is provided with a hanger rod 15. The back end of the hanger rod 15 is in contact with the front side of the vertical plate 11, hereby, a tool 96 with a hanging hole 962 can be hanged on the hanger rod 15 via the hanging hole 962. The tool 96 shown in FIG. 9 is a tool rack for arranging several sleeves 98. FIG. 9 cannot be used as an explanation for limiting the use of the present invention.

Figure 11:
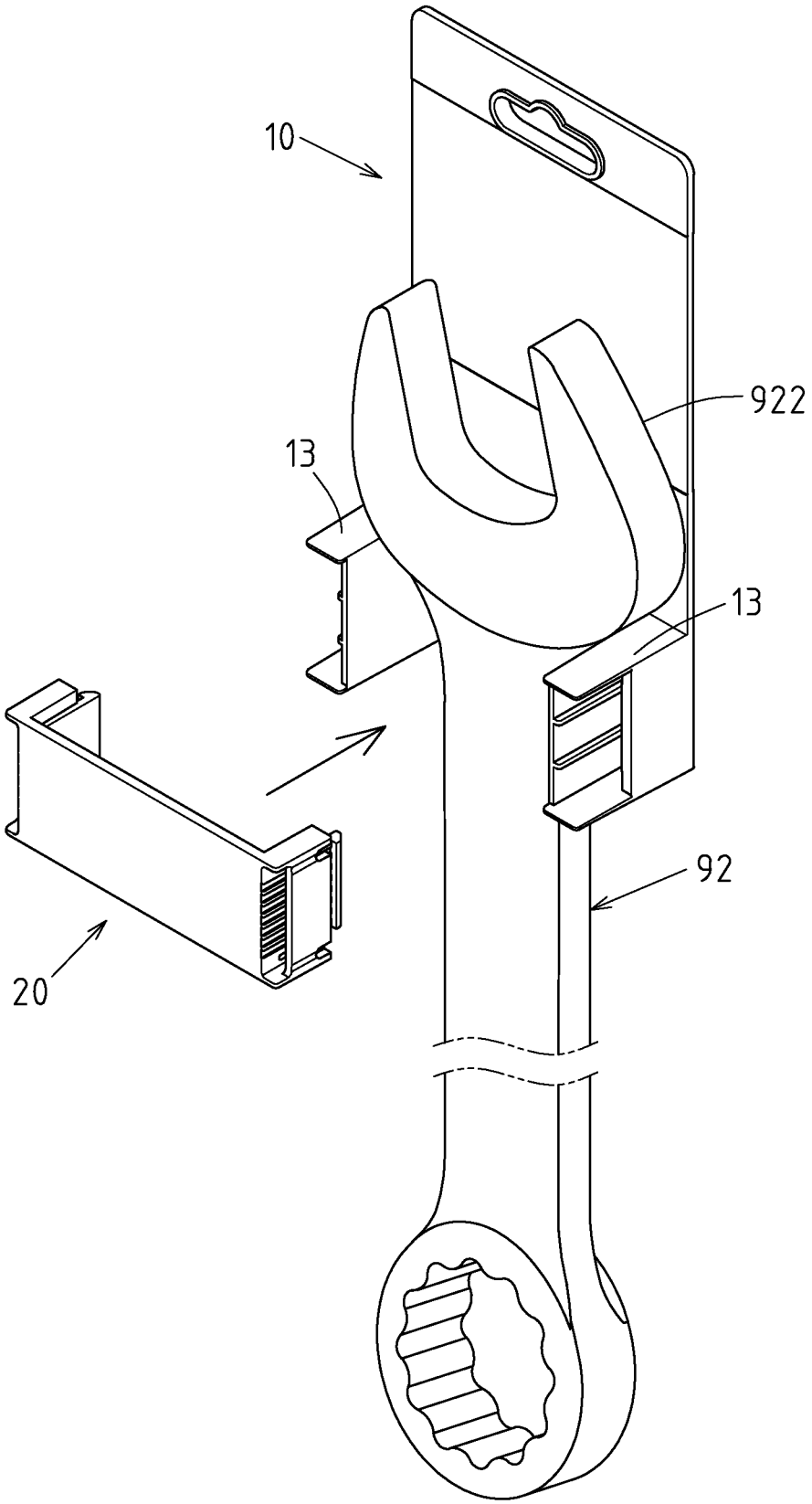
FIG. 11 is the three-dimensional diagram of setting up the tool in Embodiment 4 of the present invention.

As shown in FIG. 1 and FIG. 11, the major difference between Embodiment 4 and Embodiment 1 is that Embodiment 4 is free of the fixing part 30 of Embodiment 1, as the distance between the limiting plates 13 is smaller than the width of head 922 of the tool 92, the tool 92 will not drop off

I claim:

1. A hanging tag for tools comprises a main body, the main body comprises a vertical plate and two side plates, wherein each of the side plates is provided on both sides of the vertical plate respectively, and each of the side plates extends forward, each of the side plates forms a stopper on the front side of the vertical plate; the main body is provided with several limiting plates, each of the limiting plates is in contact with the top edge and bottom edge of each of the side plates respectively, and a demountable set of stopping members is provided on the front side of the main body; the set of stopping members comprises a middle plate, two connecting plates and two baffles; wherein the middle plate and the vertical plate are vertically opposite to each other, so that a tool is arranged between the vertical plate and the middle plate, and the set of stopping members oppositely limits the tool, the connecting plates are laterally opposite to each other; the front side of each of the connecting plates is in contact with the middle plate; each of the connecting plates forms a hook part; the top edge and bottom edge of each of the connecting plates are opposite to each of the limiting plates respectively, each of the connecting plates is elastically hooked with the stopper of each of the side plates through each of the hook parts;

each of the baffles is provided on the front side of each of the side plates, and each of the baffles is opposite to the outside of each of the connecting plates; a basal portion extends to the top edge and bottom edge of each of the baffles from the middle plate; the top edge and bottom edge of the baffle are in contact with each of the basal portions through a shearing part, so that the shearing part can be destroyed by a shearer to remove the baffles, and the set of stopping members can be separated from the main body to get the tool.

2. The hanging tag for tools defined in claim 1, wherein the main body has two reinforcing plates between the side plates, the reinforcing plates are laterally opposite to each other, and the reinforcing plates are adjacent to the side plates and the connecting plates respectively; the top edge and bottom edge of the reinforcing plates are in contact with the limiting plates respectively, so as to reinforce the limiting plates.

3. The hanging tag for tools defined in claim 1, wherein the top edge and bottom edge of the connecting plates are in contact with the basal portions respectively, so as to enhance the bonding strength between the connecting plates and the middle plate; a notch is formed near the top edge and bottom edge of the connecting plates respectively, the notches extend to the rear side of the connecting plates, and the hook parts are formed between the notches, so that the connecting plates can spring laterally.

4. The hanging tag for tools defined in claim 1, wherein the thickness of the shearing part is smaller than the thickness of the baffle, so that the shearing part is easy to be destroyed by the shearer.

5. The hanging tag for tools defined in claim 1, wherein an oblique guide face is formed on the rear side of the hook part, so as to guide the elastic deformation of the connecting plates.

6. The hanging tag for tools defined in claim 1, wherein the stopper extends to the top edge of the side plates and the bottom edge of the side plates, and contacts each of the limiting plates.

7. The hanging tag for tools defined in claim 1, there is a fixing part, wherein the fixing part is arranged between the vertical plate and the middle plate, so as to enhance the reliability of positioning the tool.

8. The hanging tag for tools defined in claim 7, wherein the fixing part is in contact with the middle plate, and the fixing part extends towards the vertical plate, so as to enhance the reliability of positioning the tool.

9. The hanging tag for tools defined in claim 7, wherein the fixing part is in contact with the vertical plate, and the fixing part extends towards the middle plate, so as to enhance the reliability of positioning the tool.

10. The hanging tag for tools defined in claim 1, wherein the main body is provided with a hanger rod, the back end of the hanger rod is in contact with the vertical plate, so that the tool can be hanged on the hanger rod through a hanging hole.

* * * * *